United States Patent [19]

Lexa

[11] Patent Number: 5,029,188

[45] Date of Patent: Jul. 2, 1991

[54] APPARATUS FOR MONITORING OPERATION CYCLES OF AN ELECTRICALLY ACTUATED DEVICE

[75] Inventor: Anthony F. Lexa, Forest, Va.

[73] Assignee: Joyner Engineers and Trainers, Forest, Va.

[21] Appl. No.: 431,094

[22] Filed: Nov. 3, 1989

[51] Int. Cl.[5] ..... G07C 3/02

[52] U.S. Cl. ..... 377/16; 377/15; 377/20; 377/112; 364/551.01

[58] Field of Search ..... 377/6, 15, 16, 55, 20, 377/112; 364/551.01

[56] References Cited

U.S. PATENT DOCUMENTS

| | | | |
|---|---|---|---|
| 3,548,165 | 12/1970 | Linnenkamp . | |
| 3,636,549 | 1/1972 | Berman et al. | 377/16 |
| 3,729,620 | 4/1973 | Jones . | |
| 3,793,509 | 2/1974 | Isnard | 377/16 |
| 4,023,015 | 5/1977 | Garcia . | |
| 4,237,371 | 12/1980 | LeBouder | 377/16 |
| 4,237,374 | 12/1980 | Malone . | |
| 4,262,842 | 4/1981 | Grover, Jr. et al. . | |
| 4,304,988 | 12/1981 | Lucas et al. | 377/55 |
| 4,398,144 | 8/1983 | Heidemann | 324/527 |
| 4,399,548 | 8/1983 | Castleberry | 377/16 |
| 4,492,925 | 1/1985 | Kammerer et al. | 324/418 |
| 4,542,649 | 9/1985 | Charbonneau et al. | 73/168 |
| 4,578,669 | 3/1986 | Woods | 340/518 |
| 4,630,292 | 12/1986 | Juricich et al. . | |
| 4,672,310 | 6/1987 | Sayed | 324/133 |
| 4,706,017 | 11/1987 | Wilson | 324/127 |
| 4,712,071 | 12/1987 | Charbonneau et al. | 324/415 |
| 4,759,224 | 7/1988 | Charbonneau et al. | 73/862.31 |
| 4,768,273 | 9/1988 | Kadlub | 29/281.6 |
| 4,782,702 | 11/1988 | Boone et al. | 73/597 |
| 4,787,245 | 11/1988 | Anderson et al. | 73/168 |
| 4,805,451 | 2/1989 | Leon | 73/168 |
| 4,835,463 | 5/1989 | Baran et al. | 324/123 R |
| 4,920,549 | 4/1990 | Dinovo | 377/15 |

*Primary Examiner*—John S. Heyman

*Attorney, Agent, or Firm*—Burns, Doane, Swecker & Mathis

[57] ABSTRACT

An actuation counter is disclosed for counting the number of operation cycles of a valve or other electrically actuated device. The counter provides a real-time output display of the count for analysis by an operator. A battery operated counting circuit is configured in a housing and is responsive to the detection of load or actuation current on a conductor to increment a stored count. The actuation current which corresponds to the operation cycles of the monitored device is detected by a current probe. A preferred embodiment the counting circuit includes a delay circuit which operates to prevent an increment in the count due to spurious signals such as those induced by contact bounce. Access ports associated with the counting circuit are provided so that an operator can determined the presence or absence of magnetic fields by the use of a voltmeter. The counting circuit also preferably includes a threshold setting circuit and reset switch.

57 Claims, 3 Drawing Sheets

APPARATUS FOR MONITORING OPERATION CYCLES OF AN ELECTRICALLY ACTUATED DEVICE

FIELD OF THE INVENTION

The present invention relates generally to an apparatus for monitoring operation cycles of an electrically actuated device. More particularly, the present invention relates to an apparatus that monitors actuation current or voltage for a valve or other current actuated device in order to provide a real-time count of a total number of device actuations in a specified time period.

BACKGROUND AND SUMMARY OF THE PRESENT INVENTION

Industries in general, and the power industry in particular, place a high emphasis on the reliability of valve operators and other electrically actuated devices. The correct operation of these electrically actuated devices have direct effects on the improvement or maintenance of plant output, and furthermore provide for the protection of other plant equipment. Often, the valves or other devices are required to operate under varying operating conditions of temperature, pressure, and flow of materials therethrough. Furthermore, the inherent operating characteristics of the electrically actuated devices and device actuators are continuously undergoing mechanical or electrical changes from maintenance, repair, adjustments, calibration and wear. Therefore, there is a great need for systems which can monitor the use, operability and reliability of such electrically actuated devices.

In particular, the valves and operators used in nuclear power plants often serve as an important component in the overall system to protect against the release of radioactive materials. Due to the vast number of valves and operators utilized in a typical nuclear power plant, the nuclear industry is fully aware of the importance of maintaining proper and continuous operation of these valves and operators as well as the need for ascertaining the probable life expectancy of the electrically actuated devices utilized therein.

Prior art systems have been proposed for the evaluation of valve and valve operator systems, particularly systems which are motor or otherwise power driven and are operated from a remote location. One proposed system for monitoring and maintaining proper operation of these critical valves is disclosed in U.S. Pat. No. 4,542,649, issued to Charbonneau et al. The system disclosed therein is directed to a valve operator and monitoring system which measures, records and correlates valve stem load, limit and torque switch positions, spring pack movement and motor current providing time related information on valve performance. The information produced by the system of this prior patent purports to provide a direct indication of developing valve and valve operator problems. Such problems include excessive or inadequate packing load, excessive inertia, proximity to premature tripping, incorrect settings of operating limit and torque switches, improperly functioning thermal overload devices, inadequate or excessive stem thrust loads, gear train wear, stem damage, and load relaxation. The Charbonneau et al patent states that this system provides for the measurement of current flowing through the operator limit and torque switches in order to provide other diagnostic data.

One of the major drawbacks of this and conventional prior art systems directed to the monitoring of the operation cycles of valves or other current actuated devices is that there is no provision for on-line cyclic counting of the total number of valve actuations. The useful life of a device can often be accurately estimated in terms of the number of actuations the device has undergone. By counting the number of actual activations, one can accurately estimate the remaining useful life of the device.

Previously proposed systems provide for off-line testing and involve the utilization of complex configurations of numerous instruments and recording equipment. For example, monitoring systems for instance, rely on computer monitoring and data recording by strip chart recorders in order to accumulate the diagnostic data of equipment when it is removed from its working environment. In such systems lengthy analysis of the diagnostic data, including the comparison of past and present strip charts generated by a series of bench tests of the equipment are not deemed to be an efficient diagnostic tool. In addition, various regulations may prohibit intrusions into the actuating system during actual operation without following substantial and burdensome procedures.

It is therefore an object of the present invention to provide a device which monitors electrical parameters of an electrically actuated device.

It is a further object of the present invention to provide a monitoring system which is capable of counting the operation cycles of a valve or other electrically actuated device to help estimate the remaining useful life of the device.

It is another object of the present invention to provide non-intrusive measurement of the operation cycles of the electrically actuated device, and thus achieve on-line cycle counting of these operations. This type of measurement obviates the need for shutting down the electrically actuated devices that is required for bench testing.

It is a further object of the present invention to provide an actuation counter which displays real-time output of operation cycles of the device being monitored.

It is still a further object of the present invention to provide an actuation counter in a small portable housing to promote easy installation in areas not readily accessible by large instruments.

An additional object of the present invention is to provide an accurate count of the total number device actuations as a measure of age and remaining useful life, thereby providing an indication of the device's reliability.

It is a further object of the present invention to provide a system which contributes to the process control of a monitored device by providing a count relating to, for example, the number of products on a specified production line or the number of on/off cycles of components such as heaters which are associated with the monitored device.

Furthermore, it is another object of the present invention to provide a system which is capable of monitoring current fluctuations of a current supplied to an electrically actuated device. An accurate measurement of current fluctuation is an aid in determining the existence of problems in the monitored device and estimating the remaining useful life of the monitored device These and other objects are achieved by the actuation counter according to the present invention which counts the number of operational cycles of an electrically actuated device. The actuation counter has associated therewith a probe which detects the presence of an electrical parameter on a conductor which carries current to the electrically actuated device. The probe generates a signal corresponding to each detection of the electrical parameter. The electrical parameter, which can be current or voltage, is generated on the conductor in order to actuate an operational cycle of the electrically actuated device. A counter circuit is provided and is operable for incrementing a stored count to a present count in response to receiving the signal from the probe which signal corresponds to the detection of the electrical parameter. A display is coupled to the counter circuit for displaying the present count of the counter circuit.

In another aspect of the present invention, the probe is operable for inducing a first voltage after detecting the presence of the actuation electrical parameter. A threshold setting circuit is coupled to the probe for setting a threshold value of the actuation electrical parameter at which the probe induces the first voltage. An amplifier is preferably coupled to the threshold setting circuit in order to amplify the first voltage to produce a second voltage. The counter circuit increments the stored count therein to a present count in response to an increment input of the counter circuit being supplied with a low voltage. The increment input of the counter circuit is otherwise maintained at a high voltage. A voltage reducing circuit, which is coupled between the amplifier and the increment input, receives the second voltage and thereafter drives the increment input with a low voltage to increment the present count. The display continuously displays the present count which corresponds to a real-time count of the operation cycles of the electrically actuated device.

According to another aspect of the present invention, a portable monitoring system obtains a count of a number of operation cycles of a current actuated device. The monitoring system produces a real-time output of the count. In addition to the features noted above, the counting circuit is arranged in a portable housing. The counting circuit also includes an operational amplifier which receives the voltage induced by the probe and transforms the voltage into an increment voltage. A counter stores and increments the count in response to an increment input of the counter supplied with a low voltage. Otherwise the increment input is supplied with a relatively high voltage of an associated battery. A transistor has its base terminal coupled to receive the increment voltage from the operational amplifier and its collector terminal connected to the increment input such that, upon the base terminal receiving the increment voltage, the collector terminal drives the increment input with a low voltage. This low voltage initiates a count increment by the counter.

In accordance with a further aspect of the present invention, a set of external access ports is provided to permit generation of an external reading of the increment voltage. A reset switch is provided to reset the counter to a count of zero. Further, a display for the count provides a real-time output of the number of operation cycles of the current actuated device.

These and other objects of the present invention will be made clear in the following detailed description of the preferred embodiments.

DETAILED DESCRIPTION OF THE PREFERRED EMBODIMENTS

Figure 1:
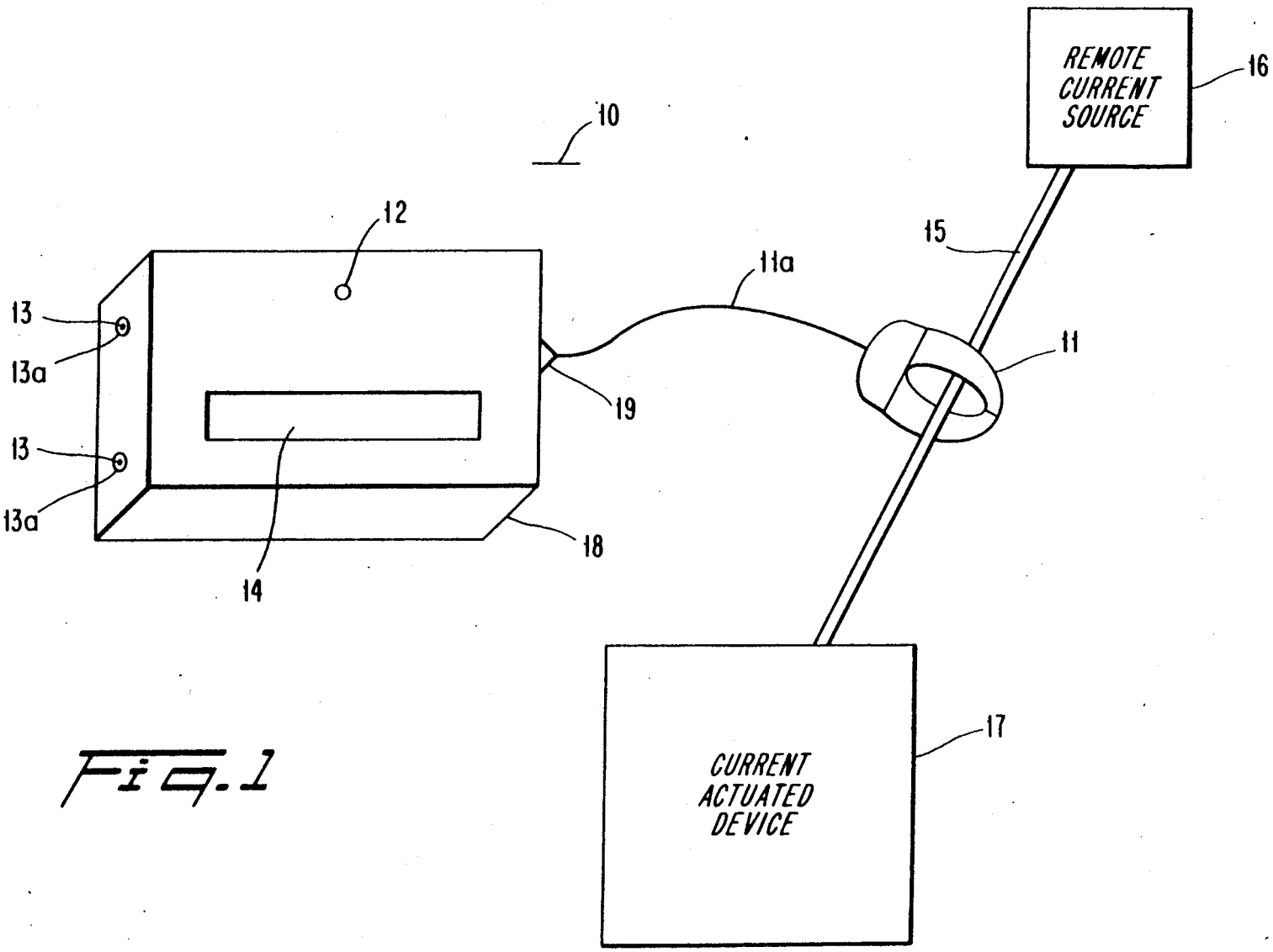
FIG. 1 is a diagram of an actuation counter according to the present invention.

With reference to FIG. 1, an actuation counter 10 according to the present invention comprises a portable housing 18 for enclosing the counting circuitry which will be explained in more detail with reference to FIG. 2. The housing 18 may typically be configured in two pieces, a base for supporting the counting circuitry and a cover for access to this circuitry. The dimensions of the housing 18 may be approximately 3"×2"×1", for example. An LCD display 14 provides a real-time digital readout of the number of operation cycles of the valve or current actuated device being monitored by the actuation counter 10. A reset switch 27 (FIG. 2) is provided and is accessible by the operator of the system through an aperture 12 in the housing 18 in order to reset the display 14 to zero by the use of a thin, elongate probe (not shown). The recessed reset switch 27 prevents the counter 10 from being reset inadvertently.

External access jacks 13 are provided to permit the operator of the system to measure the effects of possible external magnetic fields which are in the proximity of the actuation counter 10. The jacks 13 are made accessible by small apertures 13*a* on the side of the housing 18. The apertures 13*a* are configured to allow the probes of a voltmeter to be connected to the jacks 13, thus providing a measurement of the effects of external magnetic fields. A more detailed description of this measurement is provided infra.

The actuation counter 10 also includes a subminiature phone jack 19 which operates as an input for a current probe 11. In a preferred embodiment of the present invention, the current probe 11 is a non-contacting, clamp-on or "clothes pin" type AC current transformer probe connected to the actuation counter 10 through line 11*a*. The current probe 11 is normally attached to a current conductor 15 so as to monitor the load or actuation current flowing therethrough. The use of a clamp-on type probe eliminates the need to de-energize the actuated device and for splicing cables in order to connect the activation counter 10 to the current carrying conductor 15 and in effect provides for non-intrusive monitoring of the conductor 15. The power generation industry, for instance, regulates against the splicing of wires associated with the machinery within a power plant and strictly regulates by involved procedures the removal from service of critical devices.

A remote current source 16 supplies an actuation current to a current actuated device 17 via the current conductor 15. As noted earlier, the current actuated device 17 can be a valve or valve operator which is actuated in response to receiving an actuation current from a remote source. However, it should be noted that the actuation counter 10 is not limited for use only with valves. For example, the present invention can be adapted for home use to monitor the number of times certain appliances, such as lights or the compressors of refrigerators, are activated during a given time period. In addition, the present invention could also be used in more sophisticated technologies utilizing current actuated devices, for example, manufacturing plants, defense systems, transportation systems, including rapid transit train systems and airplane or aeronautical systems. In fact, the present invention may be used to count the operation cycles of a very wide range of current or voltage actuated device.

Upon the current probe 11 detecting an actuation current in current conductor 15, the actuation counter 10 will increment the digital count displayed on the LCD display 14. Thus, the actuation counter 10 is operable for counting the operation cycles of the monitored device, in this case, current actuated device 17.

Figure 2:
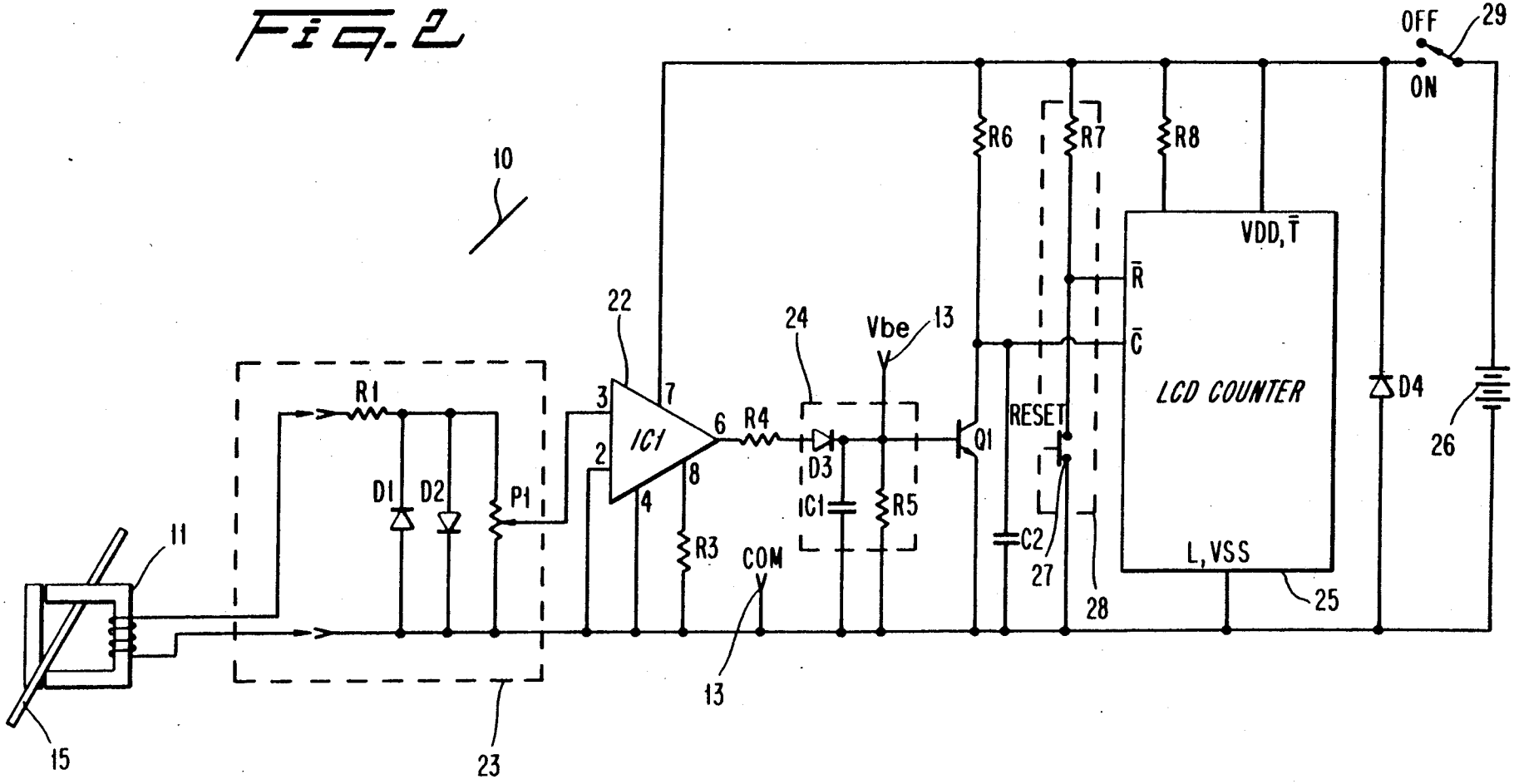
FIG. 2 is a schematic diagram of the actuation counter according to a preferred embodiment of the present invention.

Turning now to FIG. 2, a more detailed schematic diagram of a preferred form of the actuation counter 10 is presented. The illustrated actuation counter 10 senses AC current flow in the current conductor 15 by the use of the clamp-on current transformer probe 11. In operation, the AC load (current actuated device 17) and the conductor 15 effectively form the primary winding of a transformer. The secondary winding is effectively formed by the clamp-on probe 11. When a current flows to an AC load, a magnetic field is created around the load carrying conductor 15. The alternating field induces a voltage across the secondary windings in the current probe 11.

The system can easily be adapted to sense DC current flow in the conductor 15 by using a Hall-effect detector as the current probe 11 which will in effect detect the development of a transverse electric field across the conductor 15 when carrying DC current. Alternatively, the current probe 11 can be substituted with a voltage detector in order to detect an actuation voltage provided on the conductor 15. In a further embodiment, the line 11*a* could be hard-wired to conductor 15 in order to directly detect the actuation voltage.

Since the induced voltage from the current probe 11 is at the millivolt level for small load currents, the induced voltage signals are preferably amplified by an operational amplifier 22. The actuation counter 10 needs to sense a wide range of currents detected on conductor 15 which can range from approximately 0.25 amps to approximately 100 amps. In order to accommodate this wide range of currents, a sensitivity adjustment circuit 23 is provided. A resistor R1 and a potentiometer P1 form a voltage divider which reduces the voltage level from the current probe 11 to the operational amplifier 22. Furthermore, diodes D1 and D2 provide a voltage clamp across the input of the operational amplifier 22 so that the voltage to the operational amplifier 22 will not exceed approximately 0.7 volts peak to peak. The clamping diodes effectively prevent damage to the operational amplifier 22 caused by very large input signals.

The operational amplifier 22 is preferably operated in an open loop mode and provides sufficient voltage to turn transistor Q1 on. The operational amplifier 22 is preferably a micropower op-amp designed to operate on a single battery supply voltage. A resistor R3 is provided to set the supply current provided to the operational amplifier 22. The AC output of the operational amplifier 22 is half-wave rectified and current limited by a diode D3 and resistors R4, R5 to produce a rectified DC voltage. This rectified DC voltage is applied to the base-emitter junction of transistor Q1 as the base emitter voltage Vbe.

The base-emitter voltage Vbe increases and turns on transistor Q1 whenever a load current is present assuming the sensitivity adjustment is sufficient. A delay circuit 24 is provided in order to prevent false counts. A capacitor C1 limits the use time of the base-emitter voltage Vbe with a time constant of C1X(R4|R5). This time constant is selected such that no false count occurs during the initial turn on transients when contact bounce normally occurs. When the load current goes to zero, Vbe will decay with a time constant of C1XR5.

In operation with no load current, Vbe will maintain a value of about 0.1 volt which in effect is the low voltage state of the operational amplifier 22. In response to an actuation of the current actuated device 17, a load current will flow thus causing Vbe to rise with a time constant of C1X(R4|R5) and leveling off at approximately 0.6 to 0.7 volts which is the on voltage across the base-emitter junction of the transistor Q1. When the load current goes to zero, Vbe will fall to the original level with a time constant of C1|X|R5 as noted earlier. A liquid crystal display (LCD) counter 25 is provided to store and display the actual count of the detected load currents, and thus the operation cycles of the current actuated device 17. In order for the liquid crystal display counter 25 to increment by one count, the $\bar{c}$ lead associated therewith must go from a high to a low value. The liquid crystal display counter 25 counts on the trailing edge of the voltage supplied to the $\bar{c}$ lead. The value supplied to the $\bar{c}$ lead is provided by the operation of the transistor Q1. When the transistor Q1 is off (Vbe approximately equal to 0.1 volt), no current flows through the transistor Q1 and thus the $\bar{c}$ lead is held at battery voltage, Vbat, through a resistor R6. In response to the base-emitter voltage Vbe reaching approximately 0.6 volt, the collector-emitter voltage Vce of transistor Q1 drops to a low level. On this transition, i.e., high to low, the liquid crystal display counter 25 increments by one count. When the load current goes to zero and Vce is brought back to the battery voltage Vbat, the count remains unchanged. Capacitor C2 is provided to shunt any noise present on the $\bar{c}$ lead.

The actuation counter 10 further includes reset circuitry 27 which includes a resistor R7 and a reset push button 28 that provides the ability to reset the liquid crystal display counter 25 to a zero count. In operation, the reset push button 28 will be operated at initial power up in order to clear any previously existing count displays.

The liquid crystal display counter 25 is a self-contained liquid crystal display unit which is accompanied by the necessary and well known counter logic and provides a digital display through an aperture of the housing 18. The liquid crystal display counter 25 can count without reset to the six digit value of 999999 and then roll over to 0 and continue counting. A resistor R8 is a manufacture specified resistor for the supply of the scan oscillator input of the liquid crystal display counter 25.

The battery 26 is preferably a 3.6 volt lithium type battery which is designed for long shelf life and long operating life. Any other suitable battery may be used. An alternative embodiment involves substituting the battery with another power supply, such as a transformer connected to preexisting wiring or connected to power supplies of other data authorizing equipment. In embodiments that depend on an external power supply, a back-up battery may be provided.

The actual operating life of the battery obviously will depend upon a number of factors. The factors which increase the battery life include a larger initial battery capacity, a small on to off time for AC loads, and lower ambient temperatures. The actuation counter 10 should be able to operate approximately 2 or more years before battery replacement is necessary. An ON/OFF switch 29 is provided to permit the disconnection of the battery 26 during long periods of storage. In order for the operator to gain access to the ON/OFF switch 29, the housing 18 has to be partially disassembled, i.e., the cover associated with housing 18 must be removed. This configuration is preferred in order to prevent an inadvertent switching off of the actuation counter 10. However, an external battery switch (not shown) may be provided. Furthermore, diode D4 is utilized to prevent damage to the counter 25 should the battery 26 be connected backwards.

A primary concern of the system operator when installing the actuation counter 10 is to ensure the reliability of detecting actual cycle counts. There should be no extra or missing counts for the system to be effective. Missing counts may be due to insufficient sensitivity. As disclosed above, the sensitivity adjustment circuit 23 is provided so that the operator can adjust the sensitivity or the value of the actuation current that will be detected by the actuation counter 10. At maximum sensitivity, AC load currents as low as 150 ma can be detected. With the sensitivity set at 10% of maximum, the count threshold is about 1.0 amp. Therefore, the sensitivity of actuation counter 10 must be set so that the count threshold point, i.e. the point where the counter will count expressed in load current AC amps, is below the load current of the device being monitored. For example, if the AC load being monitored has a run current of 500 ma, the sensitivity of actuation counter 10 could be set so that the count threshold is approximately 450 ma. This sensitivity setting ensures reliable counts.

False counts can also be experienced if the probe is exposed to relatively strong external magnetic fields. Since the current probe 11 monitors current in the conductor 15 by sensing small magnetic fields surrounding the conductor 15, the current probe 11 will likely respond to external magnetic fields not associated with the current carrying conductor 15. Typical sources of these external magnetic fields are leakage fields from devices such as motors, transformers and other conductors carrying large currents If the current probe 11 is in a strong external magnetic field, the actuation counter 10 is likely to respond just as if a current was flowing in the conductor 15. If the magnetic field from any source is of sufficient magnitude, the actuation counter 10 will increase its count.

In order to minimize the occurrence of false counts the current probe 11 should be located as far as possible from the field sources described above. For cases where the external magnetic field is unavoidable, the effect of the external magnetic fields can be eliminated by proper setting of the sensitivity adjustment. For instance, if a the count threshold is set just below the AC load current and the effect of the external magnetic field is small as compared to the field generated by the load current, the external magnetic field will not cause false counts while the proper counting of the operation cycles is maintained.

Preferably, the actuation counter 10 includes external access jacks 13 where the presence or absence of external magnetic fields can be determined by the use of voltmeter probes (not shown) connected to jacks 13 through apertures 13*a* of housing 18. The external access jacks 13 allow the operator to directly measure the base-emitter voltage Vbe of the transistor Q1 by using a voltmeter. By placing the current probe 11 in the vicinity of the area of intended installation, any external magnetic fields which are present will be detectable due to the base-emitter voltage increasing from its steady state of approximately 0.1 volt. It is preferable for proper operation that the actuation counter 10 be installed in a location where there is no or minimal external magnetic fields However, the effects of a small external magnetic field can be compensated by the adjustment of sensitivity adjustment circuit 23 as described above.

Figure 3B:
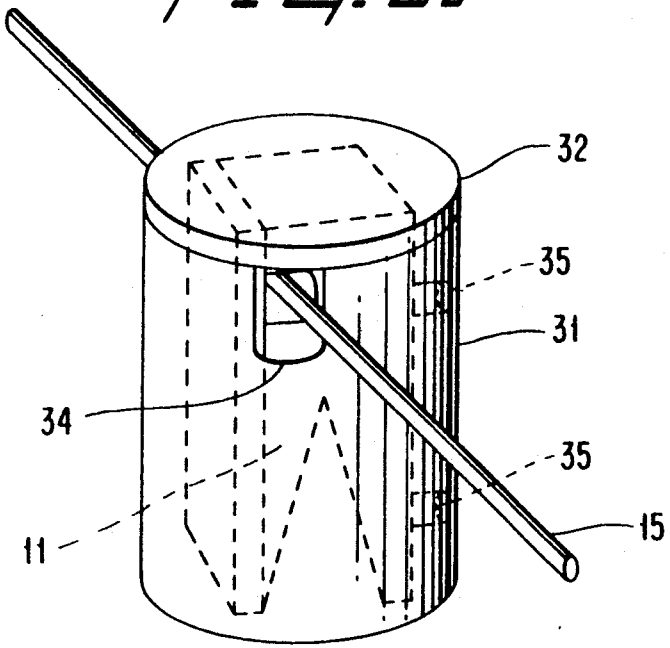
FIG. 3*b* is an illustration of a two-piece Gaussian shield for use with the current probe of the present invention.
Figure 3A:
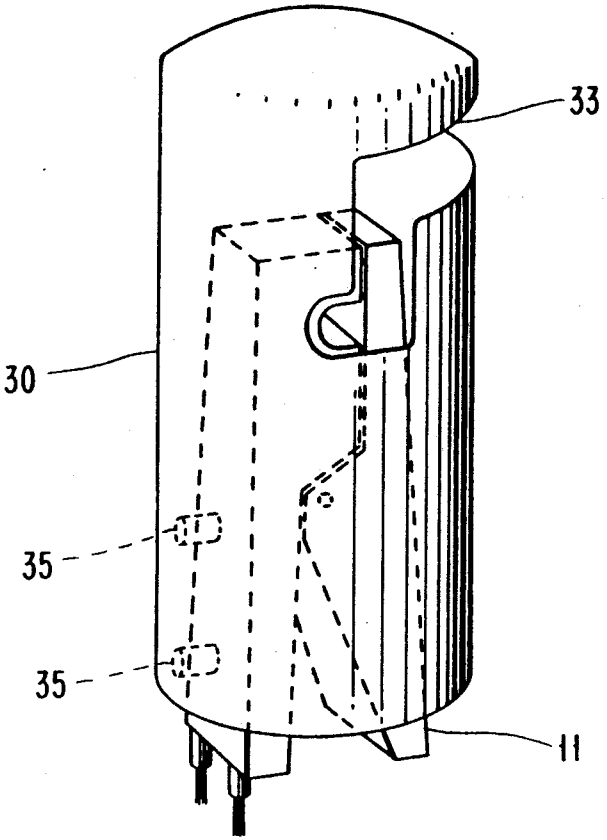
FIG. 3*a* is an illustration of a one-piece Gaussian shield for use with the current probe of the present invention.

If it is necessary to locate the current probe 11 such that the external magnetic fields are unavoidable and the load current is small requiring high sensitivity, a magnetic shield can be installed over the current probe 11. FIGS. 3*a* and 3*b* illustrate preferred embodiments of the magnetic shield to be used with the present invention. With reference to FIG. 3*a*, a one piece shield essentially consists of a cylinder 30 with a cut-out notch 33 allowing the current probe 11 to clamp on the conductor 15 while inside the cylinder 30. The current probe 11 is held by supports 35 to the inside walls of cylinder 30. Installation of the shielded probe can be easily accomplished by laying the conductor 15 into the current probe 11 jaws through the shield notch 33.

With reference to FIG. 3*b*, a two piece shield includes a cylinder 31 with two notches 34 provided 180° apart in order to receive the current carrying conductor 15. The current probe 11 is clamped around the current carrying conductor 15, thus allowing the cylinder 31 to be positioned around the current probe 11 with the current carrying conductor 15 fitting into the notches 34. A removable lid 32 is placed on the end of the cylinder 31 in order to enclose the current probe 11. The inclusion of the lid 32 may not be necessary in some applications. The previously described magnetic shields are preferably made from high permeability material which greatly reduces the effect external magnetic fields have on the sensitivity of the current probe 11.

In order to properly utilize the actuation counter 10 during operation, the current probe 11 should be attached to a single current carrying conductor 15 which supplies current to the valve or current actuated device 17 which is to be monitored. The conductor 15 can be a three phase line or a current carrying return, as long as it carries a current. Safety ground lines that do not normally carry current will not normally count the actuation of the current actuated device 17 whose current carrying conductor 15 is placed in the jaws of the current probe 11. Furthermore, cables which carry both supply and return conductors may not work as effectively because the net magnetic flux may approximate a null value. Accordingly, the current probe 11 should be attached to an individual current carrying conductor in order for the actuation counter 10 to operate most effectively.

Installation of the actuation counter 10 may be made in proximity to the current carrying conductor 15 which carries the load current of the current actuated device 17 being monitored. Alternatively, the lead line 11*a* from the current probe 11 may be extended so that the counter 10 is relatively remote from the current carrying conductor 15. Thus, the portable housing 18 can be placed at a location where the display 14 is easily seen by the operator. Alternatively, a multitude of actuation counters may be connected to a single display panel for easier evaluation by the operator.

The housing 18 can be attached to a chosen surface by the use of double-sided adhesive foam tape or double-sided adhesive hook and loop (Velcro TM) tape. The hook and loop tape allows for easy removal and installation of housing 18, while the foam tape provides the best shock absorbing properties to withstand considerable mechanical shock produced by associated machinery. If possible, the housing 18 and the probe 11 should not be located close to external sources of magnetic fields such as motors, transformers, coils, or large current carrying conductors as explained above. The presence of the external magnetic fields can be detected by the use of the external access jacks 13 with a voltmeter as described above.

In a further embodiment of the present invention, the system illustrated in FIG. 1 can be configured so that the current probe 11 is attached directly to the housing 18, thus eliminating the use of the line 11*a*. This configuration provides a more integrated system and obviates possible problems associated with line 11*a*, such as being cut or burned by machinery in the vicinity of installation. Furthermore, the actuation counter 10 of the present invention can be hard-wired directly to the current carrying conductor 15 in order to count the number of actuations. Clearly, the reduction of the required hardware has an advantage of virtually negating the effects of external magnetic fields, however, the configuration tends to be more intrusive in monitoring.

In addition, the actuation counter according to the present invention can be adapted to monitor current fluctuations in conductor 15. The actuation counter therefore provides a real-time display of the number of fluctuations in a specified time period and the degree of current fluctuation which could denote a problem in the monitored device.

The actuation counter according to the present invention can also be interfaced with a computer in order to produce historical use data, such as the generation of plots showing current or power versus time, which in turn can be compared to previously acquired plots or reference plots. By interfacing the actuation counter of the present invention with a computer it is possible to analyze current signatures of the monitored device in both time and frequency domains, thus obviating the need of waveform recorders and spectrum analyzers. The actuation counter is also easily adapted to monitor the current and voltage associated with the monitored conductor and therefore a reading of instantaneous power can be generated. In addition, the actuation counter could accommodate the on-line display of statistics associated with the previous operation cycle. These statistics can include the number of cycles, maximum or minimum current, maximum or minimum power, cycle time, and rate of change. Furthermore, the actuation counter can include an alarm which is activated in response to high/low levels of the monitored values. The above information can be obtained without requiring that the device be removed from its working environment and, with the use of the probe 11, without intruding into a preexisting circuit.

The computer interfaced embodiment may be placed on a portable rack and transported about a plant, or plants, to generate data regarding a multitude of devices. Historical information may be derived by retesting devices on-line at separate times, without requiring that the equipment be removed from its working environment.

The present invention thus described provides an actuation counter which has real-time on-line cycle counting capabilities that are critical in the power industry and others for monitoring the number of actuations of various equipment. The counter is used to measure the remaining useful life and reliability of the equipment and to count on/off cycles of any electrical device being monitored. The system provides non-intrusive measurement of monitored devices. Thus, the need for costly shutdowns of the machinery in order to accommodate bench testing of the components desired to be monitored or the splicing of electrical lines is eliminated. Furthermore, the actuation counter according to the present invention eliminates the need for expensive recording devices, such as computers or strip chart recorders, and produces a real-time output of the diagnostic data desired.

Although this invention has been shown and described with respect to preferred embodiments thereof, it will be understood that changes in form and detail thereof may be made without departing from the spirit and scope of the claimed invention.

What is claimed is:

1. An actuation counter for counting a number of operational cycles of an electrically actuated device, comprising:

probe means for detecting presence of an electrical parameter on a conductor which carries current to said electrically actuated device and for generating a signal corresponding to each detection of said electrical parameter, said electrical parameter being generated on said conductor in order to actuate an operational cycle of said electrically actuated device;

counter means operable for incrementing a stored count to a present count in response to receiving said signal from said probe means which corresponds to the detection of said electrical parameter; and display means coupled to said counter means for displaying said present count of said counter means wherein said counter means further comprises reset means for resetting said present count, said reset means includes a reset switch which is accessible by an operator through an aperture of a housing enclosing said counter means, said display means, and said reset means so as to prevent accidental resetting of said counter means.

2. The actuation counter according to claim 1, wherein said electrical parameter is current.

3. The actuation counter according to claim 1, wherein said electrical parameter is voltage.

4. The actuation counter according to claim 1, wherein said probe means is a clamp-on current transformer probe which detects AC on said conductor.

5. The actuation counter according to claim 4, wherein said electrically actuated device and said conductor effectively form a primary winding of a transformer and said clamp-on current transformer probe effectively forms a secondary winding of a transformer, and wherein said electrical parameter creates an alternating magnetic field around said conductor for inducing a voltage across said secondary winding.

6. The actuation counter according to claim 1, wherein said electrical parameter is current, and further comprising means for sensing a current fluctuation at the counter.

7. An actuation counter according to claim 1, wherein said probe means is a Hall-effect detector which detects DC on said conductor.

8. An actuation counter according to claim 1, further comprising threshold setting means coupled to said probe means for establishing a threshold value of said electrical parameter at which said signal is passed to said counter means.

9. An actuation counter according to claim 1, further comprising gate means coupled to said counter means for receiving said signal from said probe means and producing an increment count signal which initiates said counter means to increment said present count.

10. An actuation counter according to claim 8, further comprising delay means coupled to said threshold setting means for delaying said signal being passed to said counter means for a predetermined period of time.

11. An actuation counter according to claim 1, wherein said counter means and said display means are in a portable housing.

12. The actuation counter according to claim 11, wherein said counter means and said display means are powered by a battery contained in said portable housing.

13. The actuation counting according to claim 11, wherein said probe means is attached directly to said portable housing.

14. An actuation counter according to claim 1, wherein said probe means has a shield in order to reduce the effect of magnetic fields.

15. An actuation counter for counting a number of operation cycles of an electrically actuated device by monitoring for presence of an actuation electrical parameter on a conductor which supplies said actuation electrical parameter to said electrically actuated device, comprising:

probe means for detecting the presence of said actuation electrical parameter on said conductor and for inducing a first voltage;

adjustable threshold setting means coupled to said probe means for setting a threshold value of said actuation electrical parameter at which said probe means will induce said first voltage;

amplifier means coupled to said threshold setting means for amplifying said first voltage in order to produce a second voltage;

counter circuit means for incrementing a stored count to a present count in response to an increment input of said counter circuit means being supplied with a relatively low voltage, said increment input otherwise being maintained at a relatively high voltage by a voltage source;

voltage reducing means coupled between said amplifier means and said increment input for receiving said second voltage and for driving said increment input with a relatively low voltage to increment said present count; and display means coupled to said counter circuit means for continuously displaying said present count, said present count corresponding to a real-time count of the operation cycles of said electrically actuated device.

16. The actuation counter according to claim 15, wherein said actuation electrical parameter is current.

17. The actuation counter according to claim 15, wherein said actuation electrical parameter is voltage.

18. The actuation counter according to claim 15, further comprising delay means coupled between said amplifier means and said voltage reducing means for delaying transmission of said second voltage to said voltage reducing means for a predetermined period of time.

19. The actuation counter according to claim 18, wherein said transmission of said second voltage is delayed for said predetermined period of time in order to prevent false counts initiated by conditions such as contact bounce.

20. The actuation counter according to claim 15, further comprising first and second access ports which upon being coupled to a voltmeter provide a reading of said second voltage.

21. The actuation counter according to claim 20, wherein said reading of said second voltage corresponds to a measurement of relative strength of an external magnetic field in proximity to said probe means.

22. The actuation counter according to claim 15, further comprising a resetting means coupled to said counter circuit means for resetting said present count.

23. The actuation counter according to claim 15, wherein said probe means is a clamp-on current transformer probe which detects AC on said conductor.

24. The actuation counter according to claim 23, wherein said electrically actuated device and said conductor effectively form a primary winding of a transformer and said clamp-on current transformer probe effectively forms a secondary winding of a transformer, and wherein said actuation electrical parameter creates an alternating magnetic field around said conductor for including said first voltage.

25. The actuation counter according to claim 15, wherein said probe means is a Hall-effect detector which detects DC on said counter.

26. The actuation counter according to claim 18, wherein said voltage reducing means includes a transistor having its base terminal coupled to said delay means and its collector terminal coupled to said increment input of said counter circuit means.

27. The actuation counter according to claim 15, wherein said counter circuit means, said display means, said threshold setting means, said amplifier means, and said voltage reducing means are arranged in a single portable housing.

28. The actuation counter according to claim 27, wherein said probe means is attached directly to said single portable housing.

29. The actuation counter according to claim 27, wherein said single portable housing further comprises;

externally accessible ports coupled to said voltage reducing means which provide an access for an external reading of said second voltage; and a reset switch coupled to said counter circuit means operable for resetting said present count of said counter circuit means.

30. The actuation counter according to claim 15, wherein said voltage source is a battery.

31. The actuation counter according to claim 15, wherein said amplifier means is an operational amplifier.

32. The actuation counter according to claim 18, wherein said delay means is a resistor-capacitor (RC) circuit having a time constant of RxC which corresponds to said predetermined period of time, where R is a resistance value and C is a capacitance value.

33. The actuation counter according to claim 15, wherein said current probe means has a shield in order to reduce the effect of external magnetic fields.

34. The actuation counter according to claim 15, wherein a plurality of counter circuit means associated with other actuation counters are coupled to said display means.

35. The actuation counter according to claim 15, wherein said actuation counter is coupled to a computer for generating and monitoring various values.

36. The actuation counter according to claim 35, wherein said computer provides time and frequency domain analysis of a current signature of said electrically actuated device.

37. The actuation counter according to claim 35, wherein said computer generates reference plots of current or power versus time of said electrically actuated device for comparison with previously acquired reference plots.

38. The actuation counter according to claim 15, wherein both current and voltage on said conductor are monitored in order to produce a reading of instantaneous power.

39. The actuation counter according to claim 15, wherein an on-line display of statistics associated with a previous operation cycle is provided on said display.

40. The actuation counter according to claim 39, wherein said statistics include maximum or minimum current.

41. The actuation counter according to claim 39, wherein said statistics include maximum or minimum power.

42. The actuation counter according to claim 39, wherein said statistics include length of time of each of said operation cycles.

43. The actuation counter according to claim 39, wherein said statistics includes rate of change of said operation cycles.

44. The actuation counter according to claim 35, further comprising an alarm which is activated in response to monitored values exceeding a predetermined high value or being below a predetermined low value.

45. A portable monitoring system for obtaining a count of a number of operation cycles of a current actuated device, said system providing a real-time output of the count obtained for analysis by an operator, comprising:

a probe for detecting current on a conductor which supplies said current actuated device with current that initiates an operational cycle of said current actuated device, said probe inducing a voltage in response to detection of a current on said conductor which is above a predetermined threshold; and a counter circuit coupled to said probe which receives said induced voltage from said probe and in response thereto increments a count which corresponds to the number of operation cycles of said current actuated device, wherein said counter circuit is configured in a portable housing and further comprises:

(1) an operational amplifier which receives said induced voltage and transforms same into an increment voltage;

(2) a counter which stores and increments said count in response to an increment input of said counter being supplied with a low voltage, said increment input otherwise being supplied with a relatively high voltage of an associated battery;

(3) a transistor having a base terminal coupled to receive said increment voltage from said operational amplifier and a collector terminal connector to said increment input such that upon said base terminal receiving said increment voltage said collector terminal drives said increment input with a low voltage, thus initiating a count increment by said counter;

(4) a set of external access ports for providing an external reading of said increment voltage;

(5) a reset switch which when operated resets said counter to a count of zero; and (6) a display which displays said count as a real-time output of the number of operation cycles of said current actuated device.

46. The system according to claim 45, wherein said counter circuit is arranged in a single portable housing.

47. The system according to claim 46, wherein said single portable housing is a hand-held type housing.

48. The system according to claim 47, wherein said single portable housing is installed on a surface in the proximity of said conductor by the use of support means for supporting said single portable housing.

49. The system according to claim 48, wherein said support means is double-sided adhesive foam tape.

50. The system according to claim 48, wherein said support means allows ready removability and reinstallation of a single portable housing.

51. The system according to claim 46, wherein said probe is connected directly to said single portable housing.

52. The system according to claim 46, wherein said counter circuit further comprises a threshold circuit coupled between said probe and said operational amplifier which is operable for setting said predetermined threshold of said detected current.

53. The system according to claim 46, wherein said counter circuit further comprises a RC delay circuit coupled between said operational amplifier and said base terminal of said transistor which operates to delay transmission of said increment voltage to said transistor in order to prevent initiation of an increment voltage which is developed by spurious signals including external magnetic fields which induce said voltage through said probe.

54. The system according to claim 45, wherein said probe is a clamp-on current transformer probe which detects AC on said conductor.

55. The system according to claim 45, wherein said probe is a Hall-effect detector which detects DC on said conductor.

56. An actuator counter for counting a number of operational cycles of an electrically actuated device, comprising:

probe means for detecting presence of an electrical parameter on a conductor which carries current to said electrically actuated device and for generating a signal corresponding to each detection of said electrical parameter, said electrical parameter being generated on said conductor in order to actuate an operational cycle of said electrically actuated device;

counter means operable for incrementing a stored count to a present count in response to receiving said signal from said probe means which corresponds to the detection of said electrical parameter;

display means coupled to said counter means for displaying said present count of said counter means; and adjustable threshold setting means coupled to said probe means for establishing a threshold value of said electrical parameter at which said signal is passed to said counter means.

57. An actuation counter for counting a number of operational cycles of an electrically actuated device, comprising:

probe means for detecting presence of an electrical parameter on a conductor which carries current to said electrically actuated device and for generating a signal corresponding to each detection of said electrical parameter, said electrical parameter being generated on said conduction in order to actuate an operational cycle of said electrically actuated device, wherein said probe means is a clamp-on current transformer probe which detects AC on said conductor;

counter means operable for incrementing a stored count to a present count in response to receiving said signal from said probe means which corresponds to the detection of said electrical parameter;

display means coupled to said counter means for displaying said present count of said counter means.

* * * * *